US011747097B2

(12) United States Patent
Dolderer et al.

(10) Patent No.: US 11,747,097 B2
(45) Date of Patent: Sep. 5, 2023

(54) RECEIVING BOX FOR A HEAT EXCHANGER

(71) Applicant: Mahle International GmbH, Stuttgart (DE)

(72) Inventors: Axel Dolderer, Grossbottwar (DE); Gottfried Duerr, Ludwigsburg (DE); Guenther Feuerecker, Stuttgart (DE); Richard Goce, Stuttgart (DE); Benjamin Nothdurft, Stuttgart (DE)

(73) Assignee: Mahle International GmbH

( * ) Notice: Subject to any disclaimer, the term of this patent is extended or adjusted under 35 U.S.C. 154(b) by 829 days.

(21) Appl. No.: 16/724,172

(22) Filed: Dec. 20, 2019

(65) Prior Publication Data

US 2020/0200492 A1 Jun. 25, 2020

(30) Foreign Application Priority Data

Dec. 21, 2018 (DE) ..... 102018222815.9

(51) Int. Cl.
*F28D 7/06* (2006.01)
*F28F 9/02* (2006.01)

(52) U.S. Cl.
CPC ..... *F28F 9/0243* (2013.01); *F28F 9/0246* (2013.01)

(58) Field of Classification Search
CPC ..... F28F 9/0243; F28F 9/0246; F28F 9/027
USPC ..... 165/176
See application file for complete search history.

(56) References Cited

U.S. PATENT DOCUMENTS

| | | | | |
|---|---|---|---|---|
| 3,270,807 | A * | 9/1966 | Steadman | F28F 9/027 165/174 |
| 5,901,785 | A * | 5/1999 | Chiba | F28F 9/027 165/DIG. 465 |
| 8,776,873 | B2 * | 7/2014 | Mross | F28F 9/0214 165/173 |
| 9,291,407 | B2 * | 3/2016 | Huazhao | F28D 1/05391 |
| 9,759,492 | B2 * | 9/2017 | Kerler | F28D 1/05391 |
| 9,903,667 | B2 * | 2/2018 | Seo | F28F 1/12 |
| 2002/0088248 | A1 * | 7/2002 | Bureau | C09K 5/041 62/515 |
| 2007/0256821 | A1 | 11/2007 | Mashiko et al. | |
| 2014/0096944 | A1 * | 4/2014 | Seo | F28D 1/05391 165/174 |

(Continued)

FOREIGN PATENT DOCUMENTS

| | | | |
|---|---|---|---|
| CN | 103759569 | A | 4/2014 |
| DE | 102008023055 | A1 | 11/2008 |

(Continued)

OTHER PUBLICATIONS

Chinese Office Action dated Mar. 22, 2021 for copending Chinese Application No. 201911336427.8 (with English translation).

*Primary Examiner* — Claire E Rojohn, III
(74) *Attorney, Agent, or Firm* — Fishman Stewart PLLC

(57) ABSTRACT

A receiving box for a heat exchanger may include a box body delimiting at least one duct formed in the box body. The box body may include a plurality of receptacles configured to receive a plurality of tube bodies of the heat exchanger. The plurality of tube bodies may each be fluidically connected to the at least one duct. The box body may define an injection tube that extends along the at least one duct and is separated from the at least one duct via the box body. The injection tube may include at least one outlet opening fluidically connected to the at least one duct.

20 Claims, 6 Drawing Sheets

(56) References Cited

U.S. PATENT DOCUMENTS

| | | | | |
|---|---|---|---|---|
| 2020/0132378 | A1* | 4/2020 | Dong | F28D 1/0391 |
| 2022/0065542 | A1* | 3/2022 | Youn | F28F 9/028 |
| 2022/0381523 | A1* | 12/2022 | Duerr | F28D 1/05366 |

FOREIGN PATENT DOCUMENTS

| | | | |
|---|---|---|---|
| EP | 1826523 | A1 | 8/2007 |
| EP | 2990752 | A1 | 3/2016 |

* cited by examiner

RECEIVING BOX FOR A HEAT EXCHANGER

CROSS-REFERENCE TO RELATED APPLICATIONS

This application claims priority to German Patent Application No. DE 10 2018 222 815.9, filed on Dec. 21, 2018, the contents of which are hereby incorporated by reference in their entirety.

TECHNICAL FIELD

The present invention relates to a receiving box for a heat exchanger for receiving tube bodies of the heat exchanger and supplying the tube bodies with a fluid. The invention furthermore relates to a heat exchanger comprising such a receiving box.

BACKGROUND

A heat exchanger serves for the heat exchange between two fluids. For this purpose, the heat exchanger usually has a plurality of tube bodies, through which a first fluid flows and around which a second fluid flows, so that heat is transferred from one of the fluids to the other fluid during operation of the heat exchanger, and a heat exchange between the fluids thus occurs. The tube bodies are usually received in at least one receiving box of the heat exchanger, which additionally fluidically supplies the tube bodies with the fluid, which flows through the tube bodies, i.e. introduces the fluid into the tube bodies and/or discharges it from the tube bodies.

In the case of certain demands, it is desirable to allow the fluid to flow through the tube bodies with a reduced pressure. For this purpose, pressure reducers can generally be used, which can effect a pressure reduction in the fluid and which can expand the fluid. It is desirable thereby to realize such a measure inside the heat exchanger, in particular so as to be able to design the heat exchanger in a compact manner.

Such a heat exchanger is known from EP 2 990 752 A1. In the case of this heat exchanger, an injection tube is inserted as pressure reducer into one of the receiving boxes and is connected outside of the receiving box to a supply tube for supplying a fluid to the receiving box and subsequently to the tube bodies of the heat exchanger.

The complex production of the heat exchanger and of the receiving box is a disadvantage of such a design. The heat exchanger, in particular the receiving box, furthermore has an insufficient mechanical stability.

SUMMARY

The present invention thus deals with the object of specifying improved or at least alternative embodiments for a receiving box of the above-mentioned type as well as for a heat exchanger comprising such a receiving box, which are characterized in particular by a simplified production and/or an increased mechanical stability.

This object is solved according to the invention by the subject matters of the independent claim(s). Advantageous embodiments are subject matter of the dependent claim(s).

The present invention is based on the general idea of forming an injection tube for introducing a fluid into a receiving box of a heat exchanger in an integral manner on the receiving box. The receiving box as well as the associated heat exchanger can be produced in a simplified and cost-efficient manner in this way. The integral formation of the injection tube in the receiving box further has the result that the injection tube moves with the receiving box as a whole, so that the receiving box, including injection tube, is mechanically more robust and thus more stable as a whole.

In accordance with the idea of the invention, the receiving box has a box body. The box limits a duct formed in the box body. Tube bodies of an associated heat exchanger are fluidically supplied via the duct, i.e., a fluid flows via the duct into the tube bodies and/or flows out of the tube bodies during operation. Receptacles for receiving the tube bodies, which are in each case fluidically connected to the duct, are further provided in the box body in such a way that the receptacles receive the tube bodies, which, as a result, are fluidically connected to the duct and which are thus supplied with the fluid, hereinafter also referred to as first fluid. According to the invention, the box body additionally forms an injection tube, which runs along the duct and via which the first fluid is introduced into the duct during operation. The injection tube is thereby separated from the duct by means of the box body, which forms the injection tube, wherein at least one outlet opening is provided on the injection tube for introducing the fluid into the duct. The injection tube thus has at least one outlet opening, which is fluidically connected to the duct.

The formation of the injection tube by means of the box body is realized in an advantageous manner by means of a shaping of the box body. This means that the box body is shaped in such a way that it forms the injection tube. The receiving box can thus be produced in a simple and cost-efficient manner.

The injection tube and/or the at least one outlet opening are advantageously designed in such a way, in particular dimensioned in such a way that a pressure reduction of the fluid and/or an expansion of the fluid occurs when the fluid flows through the at least one outlet opening into the duct.

The injection tube advantageously flows along the duct, wherein the injection tube does not necessarily run along the entire duct. Along the duct, the injection tube can in particular be dimensioned to be smaller than the duct.

The injection tube can generally have an arbitrary cross section. The injection tube can in particular be formed in the box body in such a way that the injection tube has a round or oval cross section.

The box body can also have more than one duct, in particular two ducts. It is preferred thereby when the box body limits the at least one duct, which is formed in the box body. Associated receptacles can additionally be provided in the box body for the respective duct in such a way that the respective receptacle of the box body is fluidically connected to an associated one of the ducts. The injection tube thereby extends along at least one of the ducts. The injection tube additionally has at least one associated outlet opening for at least one of the ducts. This means that the respective outlet opening is fluidically connected to one of the ducts, so that this outlet opening is associated with this duct.

It is preferred thereby when the respective outlet opening leads into the associated duct. A direct fluidic connection thus exists between the outlet opening and the duct, so that the receiving box can be produced in a simplified and cost-efficient manner.

The injection tube can be formed by the box body in such a way that it penetrates into at least one of the ducts. This provides additional protection for the injection tube and/or leads to a compact construction of the receiving box.

The box body advantageously has an outer wall, which limits the at least one duct, in particular on the outer side.

This means in particular that the box body does not have any further components on the side of the outer wall facing away from the at least one duct. The box body and the receiving box are thus produced in a simple manner and are weight-reduced and parts-reduced. The receptacles are thereby advantageously formed in the outer wall.

In the case of a preferred option, the box body limits a first duct and a second duct. The outer wall in particular limits the first duct and the second duct on the outer side in the box body. The box body further has a central web, which limits the first duct and the second duct inside the box body, and which separates the first duct from the second duct. For the respective duct, associated receptacles for receiving associated tube bodies of the associated heat exchanger are provided in the box body, in particular in the outer wall. This means that the box body, in particular in the outer wall, has a first receptacle for receiving first tube bodies of the heat exchanger as well as second receptacles for receiving second tube bodies of the heat exchanger, wherein the first receptacles are fluidically connected to the first duct, and the second receptacles are fluidically connected to the second duct. The injection tube is thereby formed by the central web, wherein the central web is shaped to form the injection tube. The receiving box can be produced particularly cost-efficiently and mechanically stable in this way. The injection tube is thus formed in particular by the box body inside the box body and is surrounded by the central web and/or the outer wall. The result is a particularly robust formation of the injection tube and thus of the receiving box, which can further be produced in a simple and cost-efficient manner.

To form the injection tube, the box body is advantageously formed to be double-walled in the area of the injection tube, preferably exclusively in the area of the injection tube, thus has two walls. At least one of the walls is thereby shaped to form the injection tube. The box body, including at least one duct and injection tube, can thus be produced in a simple and cost-efficient manner.

It is particularly preferred thereby when the box body is made of a cohesive material, for example of sheet metal. To form the box body, the cohesive material can be shaped in such a way that the box body limits and/or forms the at least one duct and the injection tube. The receptacles and/or openings, in particular outlet openings, can be introduced into the cohesive material beforehand or subsequently. The at least one duct can additionally be closed on the front side, if required, in order to prevent an unwanted outflow of the fluid from the respective duct. For this purpose, the box body can be shaped accordingly. For this purpose, an end wall, which is separate from the box body, is preferably arranged in the box body on the front side of the duct.

It is particularly preferred when the central web of the box body is formed to be double-walled and thus has a first wall as well as a second wall, wherein the first wall limits the first duct inside the box body, and the second wall limits the second duct inside the box body. At least one of the walls is shaped to form the injection tube. Due to the central web, a separation of the ducts from one another thus takes place on the one hand, and a separation of the injection tube from the ducts on the other hand, wherein a fluidic connection of the injection tube to at least one of the ducts is realized in that the injection tube is provided with at least one outlet opening of the mentioned type, which is fluidically connected to the associated duct.

The at least one duct as well as the injection tube can generally each have arbitrary cross section, which can be flown through, and can in particular be dimensioned arbitrarily.

Embodiments are preferred, in the case of which the injection tube is smaller than at least one of the ducts, preferably than the respective duct, with regard to the cross section, which can be flown through. A compact formation of the receiving box and/or an efficient pressure reduction in the first fluid can be realized in this way. The cross section of the injection tube, which can be flown through, can in particular be less than 50%, preferably less than 30%, particularly preferably less than 20%, of the cross section, which can be flown through, of at least one of the ducts. The cross section of the injection tube can in particular be between 10 $mm^2$ and 15 $mm^2$, for example 13 $mm^2$.

Embodiments are preferred, in the case of which the at least one outlet opening does not face the receptacle of the associated duct. This is in particular realized in that the outlet opening and the receptacles are at an angle of between 30° and 170° to one another. This means that an opening flow area, by means of which at least one of the outlet openings, advantageously the respective outlet opening, is connected to the associated duct, in particular leads into the associated duct, is at an angle within said range with a receptacle flow area of at least one of the receptacles of the associated duct, preferably of the respective receptacle of the associated duct, in particular with which the receptacle leads into the duct. It is thus in particular prevented that, prior to flowing through the receptacle or into the tube body, which is received in the receptacle, respectively, the fluid, which flows through the outlet opening, has an extended flow path, so that, prior to flowing into the tube body, the fluid has a lower pressure and/or is expended more strongly. The efficiency of the associated heat exchanger can be improved in this way.

The first fluid can generally be brought into the injection tube in any way.

Embodiments turn out to be advantageous, in the case of which the injection tube has an inlet opening on the end side, through which the first fluid reaches into the injection tube.

The inlet opening is advantageously fluidically connected to a connection opening of the receiving box, through which the first fluid reaches into the receiving box. The connection opening can in particular be part of a connecting piece of the receiving box, which surrounds or encloses, respectively, the connection opening. It is preferred when the connection opening, optionally including connection collar, is also formed in the box body.

A flow of the first fluid through the receptacles, which are connected to at least one of the ducts, advantageously takes place via the injection tube and the at least one outlet opening, which is fluidically connected to the duct. It is preferred thereby when, apart from unintentional leakages, this fluidic connection occurs and is realized exclusively via the injection tube. It is prevented in this way that fluid reaches into the duct with increased pressure by bypassing the injection tube. A flow path of the first fluid, hereinafter also referred to as first flow path, thus leads through the connection opening and the inlet opening of the injection tube to the at least one outlet opening of the injection tube and subsequently into the associated duct and then into the associated tube bodies, which are received in the receptacles.

The injection tube can generally have a single outlet opening, which is fluidically connected to the associated duct.

It is also conceivable to provide the injection tube with at least two outlet openings, which are spaced apart from one another along the injection tube. It is possible in this way to homogenously introduce the first fluid into the associated duct.

If the injection tube has a plurality of outlet openings, it is conceivable to fluidically connect all outlet openings of the injection tube to one of the ducts. The duct, which is fluidically connected to the outlet openings, can thereby be used to introduce the first fluid into the associated tube bodies, for example the first tube bodies, whereas the other duct is used to discharge the first fluid from the corresponding tube bodies, in particular the second tube bodies. A fluidic connection is advantageously used in this case between the tube bodies, which are connected to the first duct, and those connected to the second duct, so that the first fluid flows out of the first tube bodies into the second tube bodies. For this purpose, the associated heat exchanger, in particular located opposite the receiving box, can have a deflection box.

It is also conceivable that the injection tube has at least one associated outlet opening for the respective duct, so that the first fluid is introduced into the respective duct via the injection tube, which first fluid subsequently flows into the associated tube bodies. It is advantageous in this case when the associated heat exchanger discharges the first fluid out of the tube bodies via an outlet, which can be provided, for example, in a receiving box.

It goes without saying that apart from the receiving box, a heat exchanger comprising such a receiving box also belongs to the scope of this invention.

In addition to the receiving box, the heat exchanger has the tube bodies, through which the first flow path of the first fluid leads. The tube bodies are thereby arranged in a second flow path of a second fluid, which is fluidically separated from the first flow path, so that a heat exchange between the first fluid and the second fluid occurs during operation of the heat exchanger.

The first fluid and the second fluid can generally each be arbitrary fluids. The first fluid can be, for example, a coolant or refrigerant. The second fluid can in particular be air.

The heat exchanger, in particular the injection tube, is advantageously designed in such a way that an evaporation of the first fluid, in particular of the refrigerant and/or of the coolant, occurs due to the injection tube. The heat exchanger is thus in particular designed as an evaporator.

It is conceivable to provide a pressure reducer in the first flow path of the first fluid upstream of the injection tube, in particular also upstream of the receiving box, so that the first fluid flows into the receiving box and into the injection tube with a reduced, in particular predetermined pressure. The pressure reducer can thereby expand the first fluid.

The heat exchanger can be used in any application. This includes the use of an air-conditioning system, for example of a vehicle.

Further important features and advantages of the invention follow from the subclaims, from the drawings, and from the corresponding figure description on the basis of the drawings.

It goes without saying that the above-mentioned features, and the features, which will be described below, cannot only be used in the respective specified combination, but also in other combinations or alone, without leaving the scope of the present invention.

Preferred exemplary embodiments of the invention are illustrated in the drawings and will be described in more detail in the following description, wherein identical reference numerals refer to identical or similar or functionally identical components.

BRIEF DESCRIPTION OF THE DRAWINGS

In each case schematically.

DETAILED DESCRIPTION

Figure 1:
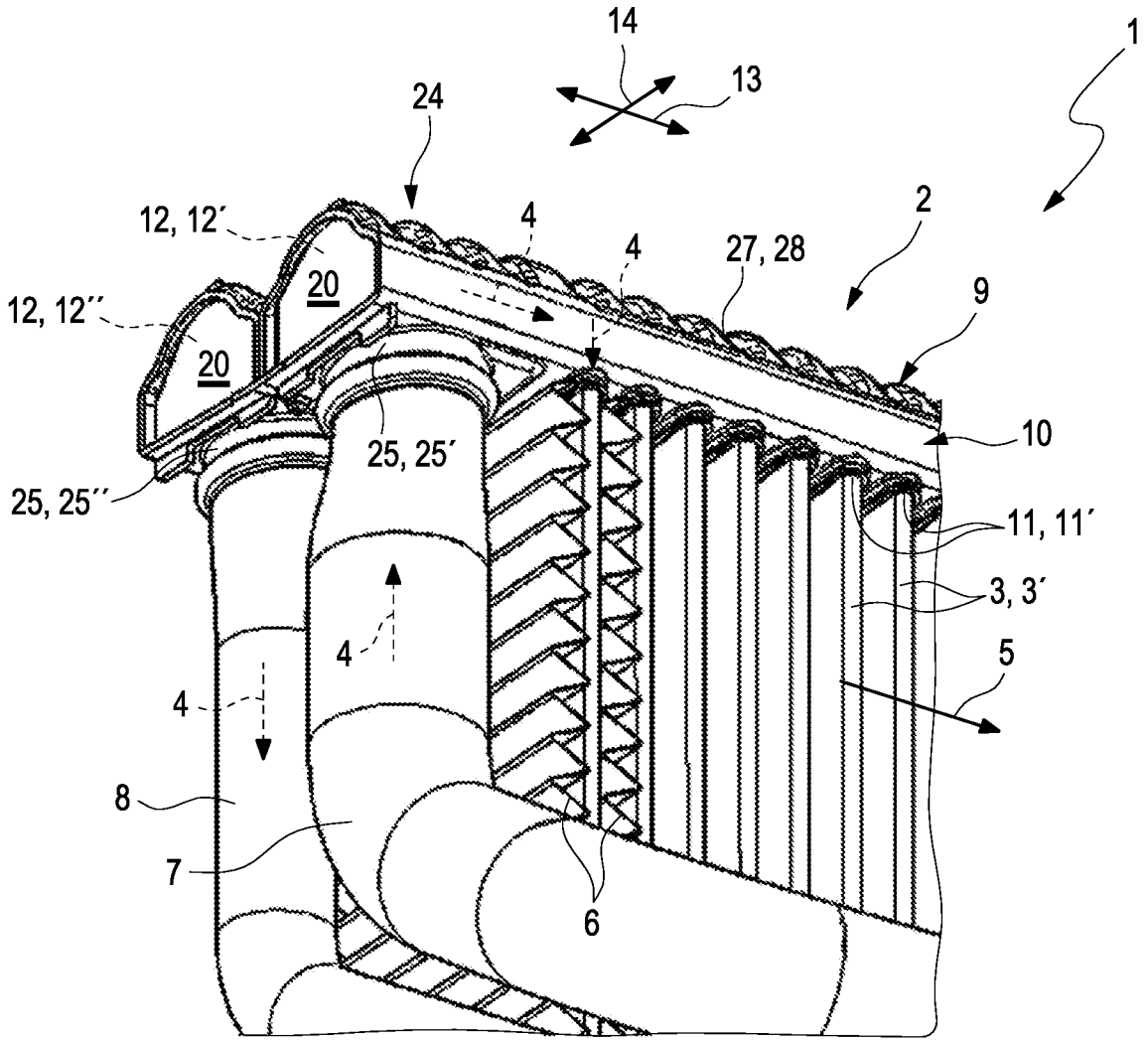
FIG. 1 shows an isometric view of a heat exchanger comprising a receiving box.

A heat exchanger 1, as it is shown, for example, in FIG. 1, has at least one receiving box 2, in which tube bodies 3 of the heat exchanger 1 are received and are supplied via the receiving box 2 with a first fluid, the flow path 4 of which, hereinafter also referred to as first flow path 4, leads through the receiving box 2 and the tube bodies 3. The tube bodies 3 are arranged in a flow path 5 of a second fluid, hereinafter also referred to as second flow path 5, wherein the first flow path 4 is fluidically separated from the second flow path 5. A heat exchange between the first fluid and the second fluid thereby occurs during operation of the heat exchanger 1. Corrugated fins 6, which enlarge the heat-transferring surface in the second flow path 5, can be arranged between the tube bodies 3. In the case of the example shown in FIG. 1, the heat exchanger 1 has first tube bodies 3' and second tube bodies 3" (see FIG. 7), wherein the second tube bodies 3" are not visible in the view shown in FIG. 1. A first supply duct 7 thereby supplies the heat exchanger 1 with the first fluid, which is discharged from the heat exchanger 1 via a second supply duct 8. In the case of the example shown in FIG. 1, both supply ducts 7, 8 are fluidically connected to the shown receiving box 2, so that the supply and the discharge of the first fluid occurs via the receiving box 2.

The receiving box 2 has a box body 9. The box body 9 has an outer wall 10, which is provided with receptacles 11 for the tube bodies 3, wherein an associated tube body 3 is received in the respective receptacle 11. The outer wall 10 limits two ducts 12 running through the box body 9, namely a first duct 12' and a second duct 12", on the outer side. The ducts 12 extend in a longitudinal direction 13 and are arranged adjacently in a transverse direction 14, which runs transversely to the longitudinal direction 13. In the outer wall 10, first receptacles 11' are provided for the first tube bodies 3', which are fluidically connected to the first duct 12' in such a way that the first tube bodies 3' received in the first receptacles 11' are fluidically connected to the first duct 12'. The outer wall 10 is further provided with second receptacles 11" (see, for example, FIG. 4), which are not visible in FIG. 1 and which receive the second tube bodies 3" and which are fluidically connected to the second duct 12" in such a way that the second tube bodies 3" are fluidically connected to the second duct 12". It is assumed in FIG. 1 that the first fluid flows via the first duct 12' into the first tube bodies 3' and subsequently flows via the second tube bodies 3" into the second duct 12". The first fluid then flows out of the second duct 12" to the second supply duct 8. For this purpose, the heat exchanger 1 advantageously has a fluidic connection, which is not shown in FIG. 1, in particular located opposite the receiving box 2, between the first tube bodies 3' and the second tube bodies 3".

Figure 2:
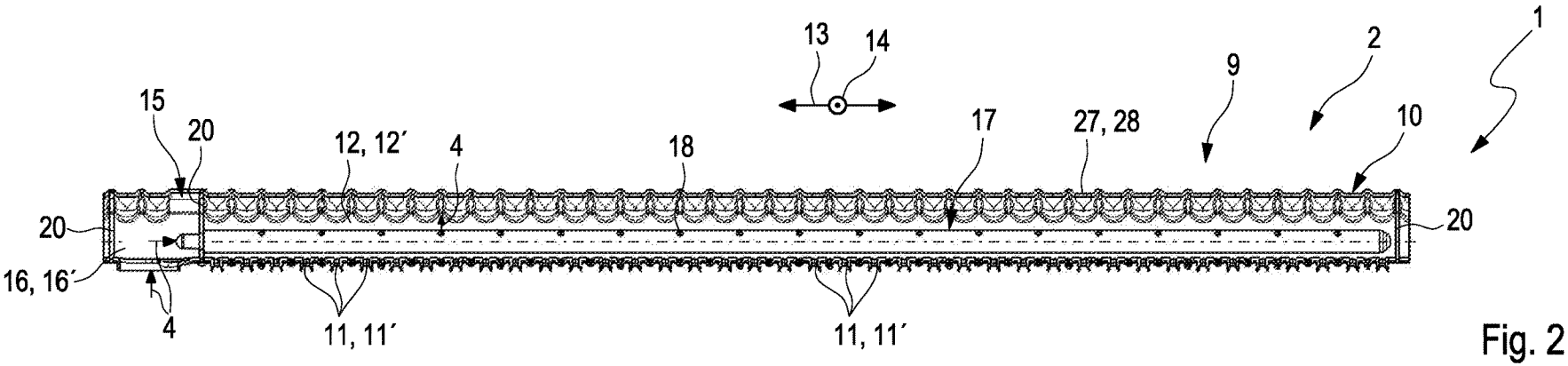
FIG. 2 shows a longitudinal section through the receiving box.
Figure 4:
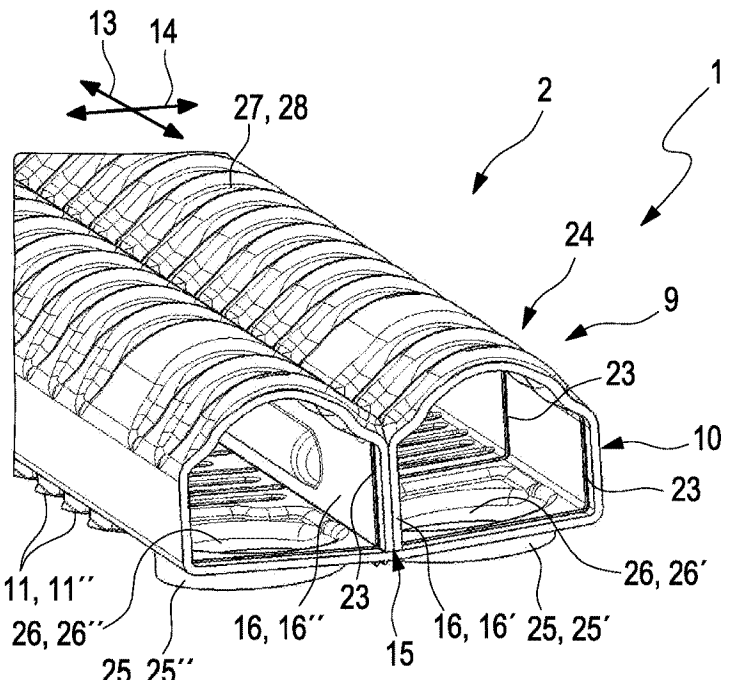
FIG. 4 shows another isometric view of the receiving box.
Figure 3:
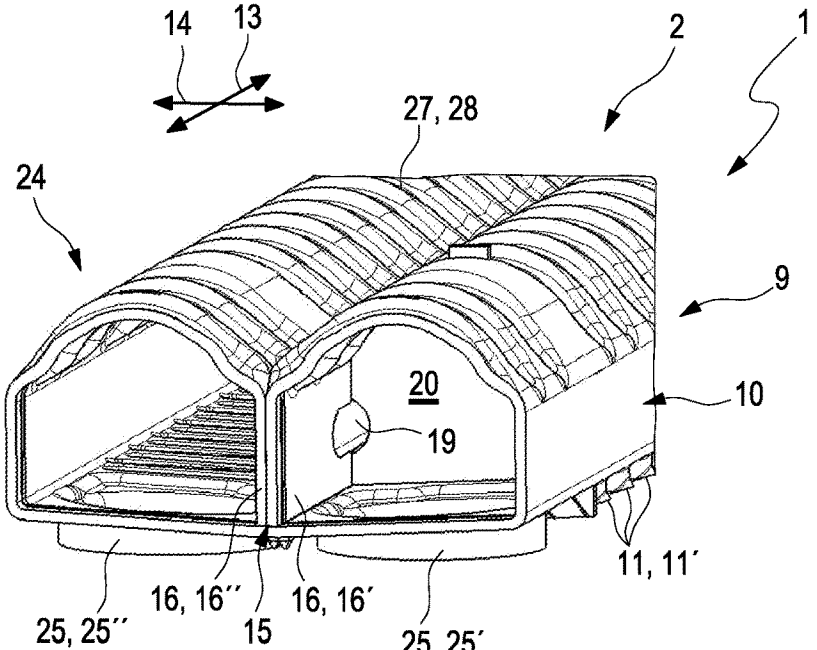
FIG. 3 shows an isometric view of the receiving box.
Figure 5:
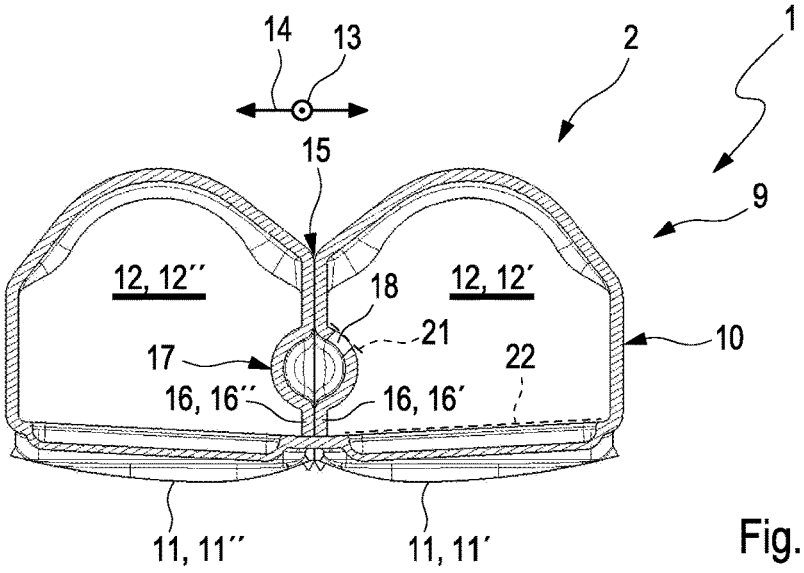
FIG. 5 shows a cross section through the receiving box.
Figure 6:
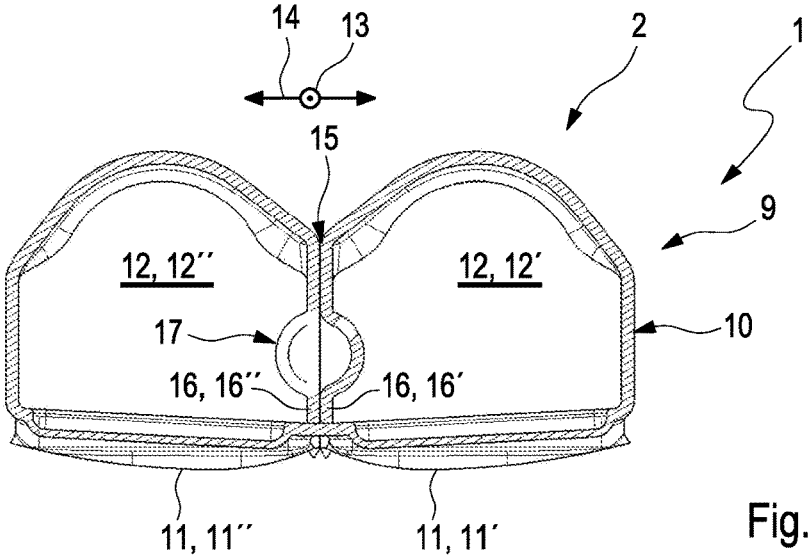
FIG. 6 shows another cross section through the receiving box.

Different views of the receiving box 2 are shown in FIGS. 2 to 6, wherein FIG. 2 shows a longitudinal section through the receiving box 2 in the area of the first duct 12', while FIGS. 3 and 4 show different isometric views of the receiving box 2. FIGS. 5 and 6 show different cross sections through the receiving box 2.

The receiving box 2 has a central web 15, which is arranged inside the receiving box 2 and in the transverse direction 14 between the ducts 12. The central web 15 separates the first duct 12' from the second duct 12" inside the box body 9. The central web 15 is thereby embodied to be double-walled, thus has two walls 16, namely a first wall 16' and a second wall 16". The central web 15 forms an injection tube 17, through which the first flow path 4 of the first fluid leads. The injection tube 17 thereby has at least one outlet opening 18, which is fluidically connected to at least one of the ducts 12, so that a fluidic connection is established between the injection tube 17 and the associated duct 12 via the at least one outlet opening 18. In the case of the example shown in FIGS. 1 to 6, the injection tube 17 has a plurality of such outlet openings 18. FIG. 5 thereby shows a cross section through one of the outlet openings 18, and FIG. 6 shows a cross section outside of the outlet openings 18.

The injection tube 17 serves to introduce the first fluid into the first duct 12' in such a way that a pressure reduction and expansion of the first fluid occurs via the injection tube 17 and the outlet openings 18, before the first fluid flows into the tube bodies 3, here thus into the first tube bodies 3'. The first flow path 4 thus leads through the outlet openings 18 into the first duct 12'. The injection tube 17 extends along the ducts 12, 12' and thus in the longitudinal direction 13, wherein the outlet openings 18 are spaced apart from one another along the injection tube 17. In contrast, the injection tube 17 is separated from the second duct 12", thus does not have any outlet openings 18 for the second duct 12". As can in particular be gathered from FIGS. 3 to 6, the injection tube 17 in the shown examples is formed by a shaping of at least one of the walls 16, here by the shaping of both walls 16, of the central web 15, which are each shaped approximately semi-circularly into the respective adjacent duct 12, so that the injection duct 17 has an essentially round cross section, which can be flown through in the longitudinal direction 13.

To admit the first fluid into the injection tube 17, the injection tube 17 is provided at one end with an inlet opening 19, which is fluidically connected to the first supply duct 17. The fluidic connection is thereby realized in such a way that the first fluid only flows via the inlet opening 19 and subsequently via the at least one outlet opening 18 into the first duct 12'. As is shown in particular by a comparison between FIGS. 3 and 4, the inlet opening 19 of the injection tube 17 is introduced exclusively into the first wall 16'. The second wall 16" is thus free from openings and is shaped to form the injection tube 17. In the shown examples, an end wall 20, which closes the first duct 12', is additionally provided in the first flow path 4 downstream from the inlet opening 19 in the first duct 12' and upstream of the receptacle 11' of the first duct 12' most closely adjacent to the inlet opening 19. A further end wall 20, which is spaced apart from this end wall in the longitudinal direction 13, limits the duct 12' on the far side in the longitudinal direction 13. The respective end wall 20 is guided in an associated recess 23 of the box body 9, wherein one of the recesses can be seen in FIG. 4 and wherein the end wall 20 is not shown in FIG. 4 for this purpose.

It can be seen from FIGS. 2 and 5 that the outlet openings 18 can face away from the receptacles 11 of the associated duct 12. In the shown example, the outlet openings 18 thus face away from the first receptacles 11'. An opening flow area 21 of the respective outlet opening 18, which is illustrated by means of dashes in FIG. 5, with which the outlet opening 18 leads into the first duct 12', is thereby at an angle of between 30° and 170° with a receiving flow area 22 of the respective first receptacle 11', which is suggested by means of dashes in FIG. 5, with which the receptacle 11' leads into the first duct 12'.

In the shown examples, the receiving box 2, in the shown examples the box body 9, has a connecting section 24, which adjoins the receptacles 11 in the longitudinal direction 13 and at which the supply ducts 7, 8 are connected to the receiving box 2 and are fluidically connected to the receiving box 2.

In the example shown in FIGS. 1 to 6, the connecting section 24 is provided with two connecting pieces 25, namely a first connecting piece 25' and a second connecting piece 25", in the area adjoining the receptacles 11, wherein the respective connecting piece 25 encloses a connection opening 26 in such a way that the first connecting piece 25' encloses a first connection opening 26', and the second connecting piece 25" encloses a second connection opening 26". The first supply duct 7 is inserted and received in the first connecting piece 25' and is thus connected to the inlet opening 19 of the injection tube 17 via the first connection opening 26'. The second supply duct 8 is inserted and received in the second connecting piece 25" and is thus connected to the second duct 12" via the second connection opening 26". The connecting pieces 25 are oriented parallel to the tube bodies 3 in this example.

On the side of the respective connecting piece 25 facing away from the receptacles 11, a further end wall 20 of the receiving box 2 is introduced and received in an associated recess 23, in order to prevent an outflow of the first fluid from the receiving box 2 via the otherwise open side of the receiving box 2, wherein these end walls 20 can only be seen in FIG. 1.

As can be seen in the figures, the box body 9 can be provided on the side facing away from the receptacles 11 with depressions 27 or beads 28, which in particular serve for a mechanical stabilization of the box body 9. The depressions 27 or beads 28, respectively, are thereby introduced into the outer wall 10.

Figure 7:
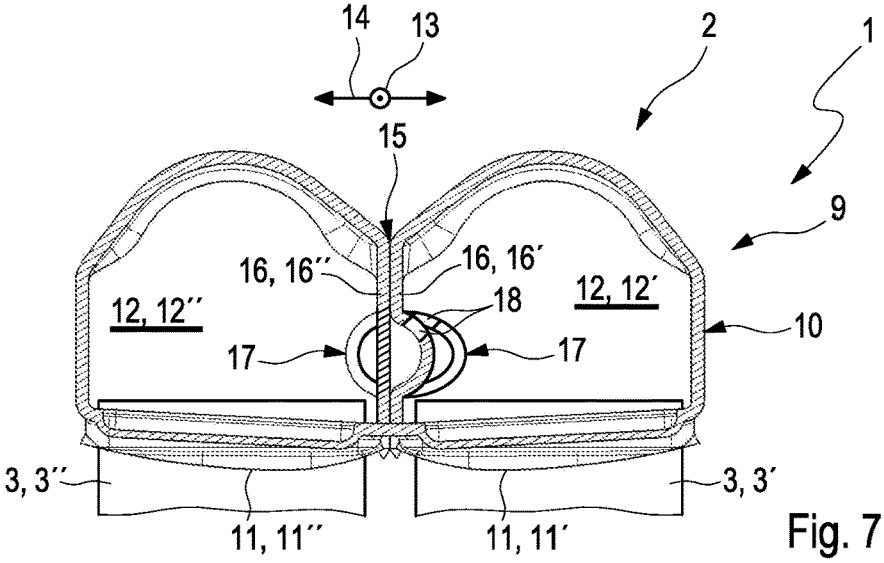
FIG. 7 shows a cross section through the receiving box in the case of different exemplary embodiments.

The view from FIG. 5 can be seen in FIG. 7, but with the tube bodies 3. As can be gathered from FIG. 7, the respective tube body 13 is inserted into the associated receptacle 11 in such a way that the tube body 3 penetrates into the associated duct 12 on the front side.

Different options of the shape of the injection tube 17 are further shown in FIG. 7. It can in particular be seen that, apart from the round cross section shown in FIGS. 2 to 6, the injection tube 17 can also have a semi-circular or an oval cross section. It is likewise possible to form the injection tube 17 by shaping only one of the walls 16 of the central web 15, which otherwise run in a flat manner.

It can further be seen in FIGS. 2 to 7 that the injection tube 17 always has a smaller cross section, which can be flown through, than the respective duct 12.

Figure 8:
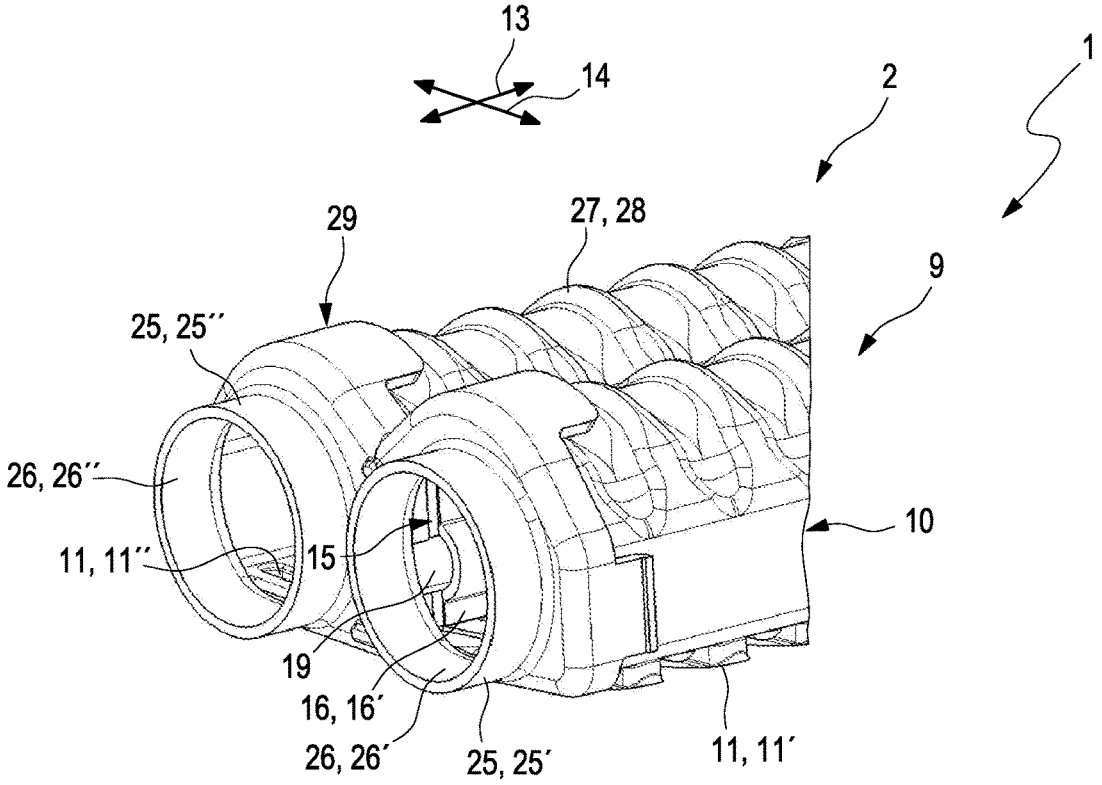
FIG. 8 shows an isometric view of the receiving box in the case of another exemplary embodiment.
Figure 9:
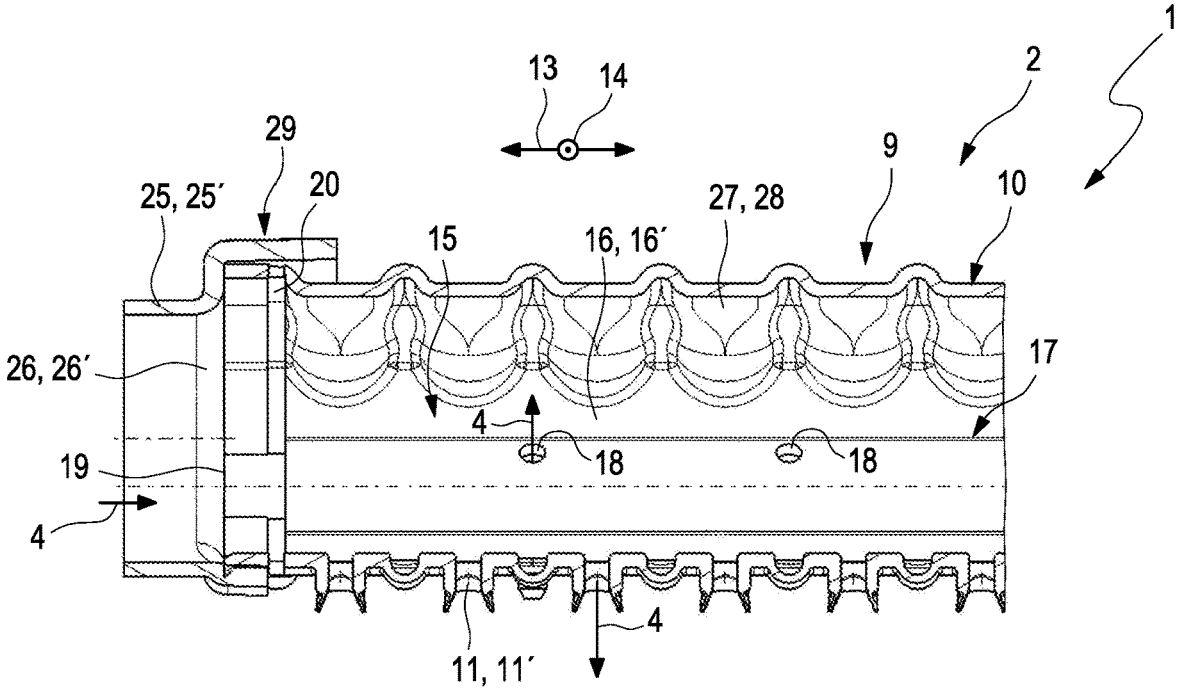
FIG. 9 shows a longitudinal section through the receiving box from FIG. 8.

Another exemplary embodiment of the receiving box 2 is shown in FIGS. 8 and 9. This exemplary embodiment differs from the example shown in FIGS. 2 to 6 by the arrangement and design of the connecting pieces 25. In this example, the connecting pieces 25 are formed by an attachment 29, which is attached to the box body 9 on the front side in the longitudinal direction 13, wherein the connecting pieces 25 are oriented in the longitudinal direction 13. It is likewise conceivable to provide a separate attachment 29 for the respective connecting piece 25.

Figure 10:
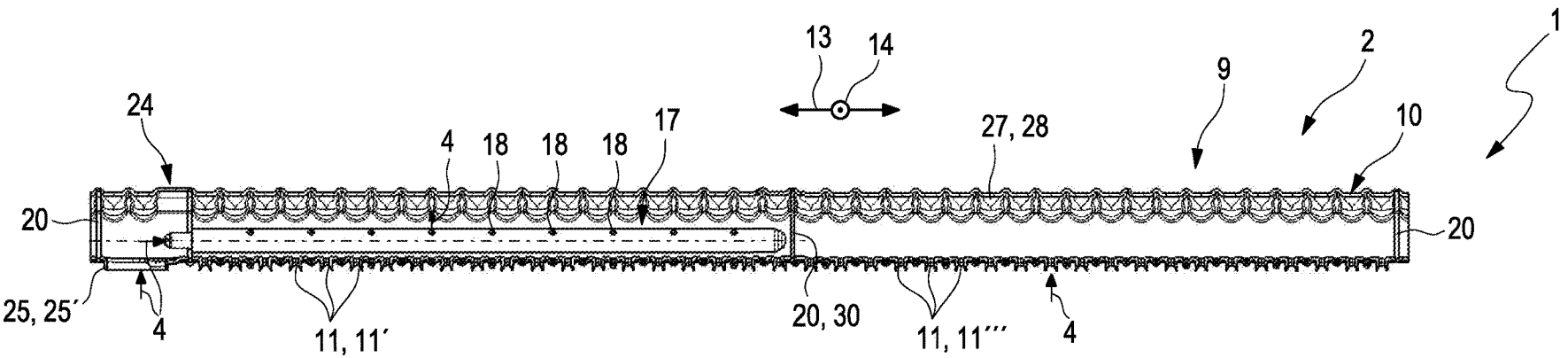
FIG. 10 shows a longitudinal section through the receiving box in the case of another exemplary embodiment.
Figure 11:
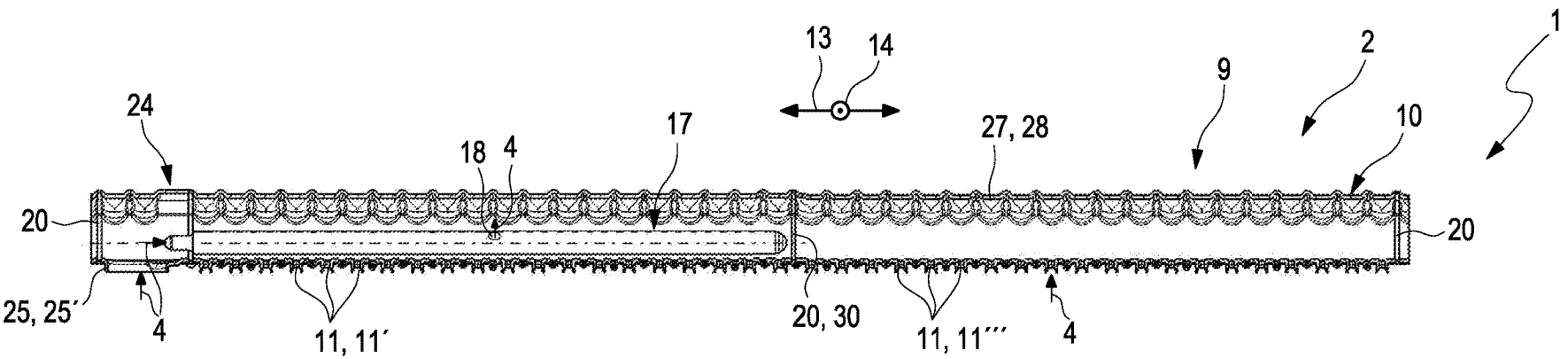
FIG. 11 shows a longitudinal section through the receiving box in the case of a further exemplary embodiment.

Further exemplary embodiments of the receiving box 2 are shown in FIGS. 10 and 11. These exemplary embodiments differ from the examples shown in FIGS. 2 to 6 in that the injection tube 17 extends only over a portion of the receiving box 2 or of the box body 9, respectively, in the longitudinal direction 13. As in the example of FIG. 10, the injection tube 17 can have a plurality of outlet openings 18 or, as in the example of FIG. 11, only one outlet opening 18, via which the injection tube 17 is fluidically connected to the first duct 12'.

In the examples of FIGS. 10 and 11, an end wall 20 or baffle 30, which limits the first duct 12' in the longitudinal direction 13, can be arranged in the box body 9, wherein receptacles 11 adjoining the first duct 12' in the longitudinal direction 13, hereinafter also referred to as third receptacles 11''', in which non-illustrated tube bodies 3 are received, via which the first flow path 4 leads back into the receiving box 9, as suggested in FIGS. 10 and 11, can be provided in the box body 9.

Figure 12:
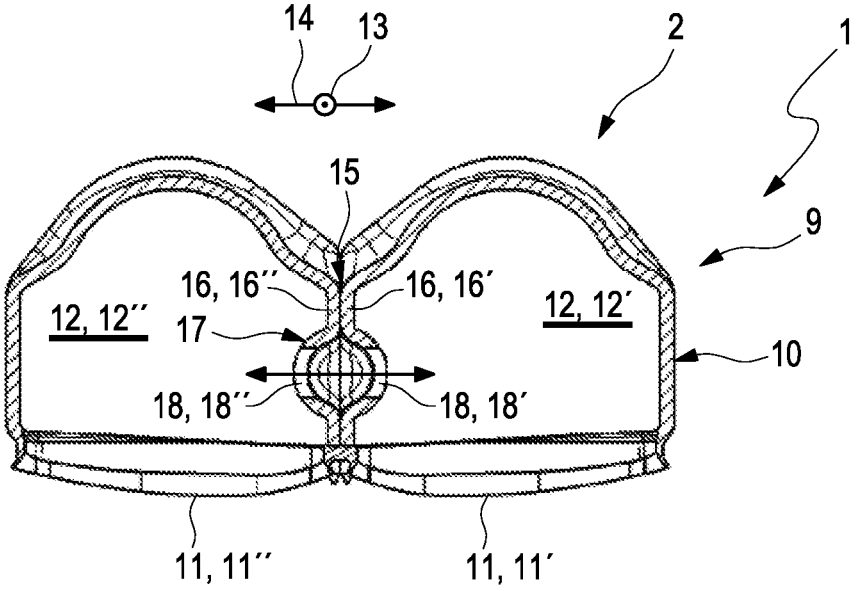
FIG. 12 shows a cross section through the receiving box in the case of another exemplary embodiment.

As shown in FIG. 12, the receiving box 2 can also be designed in such a way that the injection tube 17 is connected to the respective duct 12 via at least one outlet opening 18 each. This means that the injection tube 17 can have at least one first opening 18' and at least one second opening 18'', wherein the at least one first outlet opening 18' is fluidically connected to the first duct 12', in particular leads into the first duct 12', while the at least one second outlet opening 18'' is fluidically connected to the second duct 12'', in particular leads into the second duct 12''. In the case of this exemplary embodiment, the first fluid can thus be introduced into both ducts 12 via the injection duct 17 and can flow from there into the tube bodies 3. In the case of this exemplary embodiment, the second supply duct 8 would thus not be connected to the shown receiving box 2, but for example to a non-illustrated collector, in order to discharge the first fluid from the tube bodies 3. The shown receiving box 2 can alternatively be a receiving box, in the case of which the first fluid flows from one of the ducts 12 into the other duct 12. In this case, the receiving box 2 would thus be designed to divert the first fluid between the ducts 12.

In the case of the shown examples in FIGS. 1 to 12, the box body 9 in each case limits two ducts 12.

Figure 13:
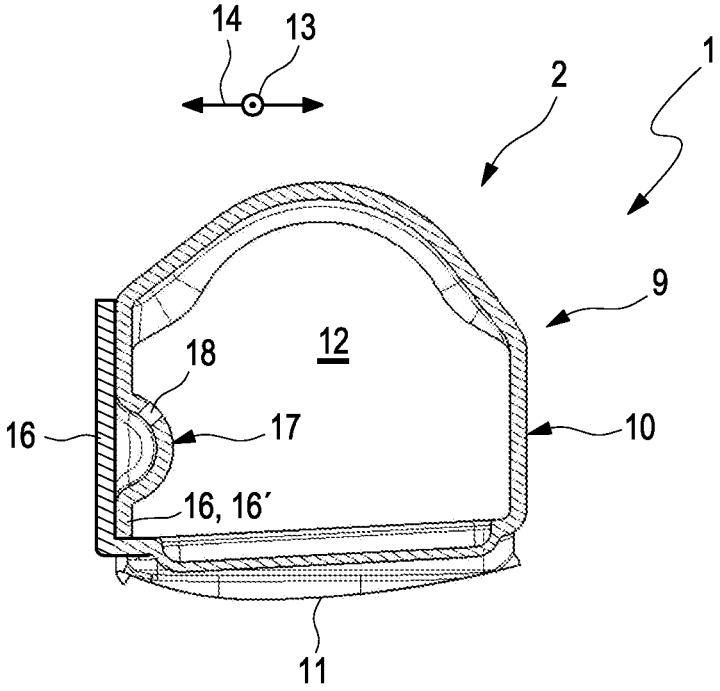
FIG. 13 shows a cross section through the receiving box in the case of a further exemplary embodiment.

In contrast, only one duct 12 is limited by the box body 9, in particular the outer wall 10, in the example of FIG. 13, wherein the box body 9 is formed to be double-walled in the area of the injection duct 17. One of the walls 16, in the shown example the wall 16' facing the duct 12, is shaped to form the injection duct 17. It is also conceivable to shape both ducts 16 or only the wall 16, which faces away from the duct 12, to form the injection duct 17.

In the case of all of the shown examples, the box body 9 is made of a cohesive material, for example of sheet metal. For this purpose, the cohesive material is shaped to limit the at least one duct 12 and to form the injection tube 17. The receptacles 11 and the outlet opening 18 as well as the inlet opening 19 are in each case introduced into the cohesive material prior to the shaping or after the shaping. The same applies for the connection openings 26 in the example of FIGS. 1 to 6 as well as 10 and 11.

The invention claimed is:

1. A receiving box for a heat exchanger, comprising:

a box body defining a plurality of ducts;

the box body including a plurality of receptacles configured to receive a plurality of tube bodies of the heat exchanger, the plurality of tube bodies each fluidically connected to at least one of the plurality of ducts;

wherein the box body defines an injection tube that extends along the plurality of ducts and is separated from the plurality of ducts via the box body;

wherein the injection tube includes at least one outlet opening fluidically connected to an associated duct of the plurality of ducts;

wherein the box body further includes an outer wall that defines a first duct of the plurality of ducts and a second duct of the plurality of ducts in the box body on an outer side;

wherein the box body further includes a central web that partially defines the first duct and the second duct in the box body, and which separates the first duct from the second duct;

wherein the plurality of receptacles includes a plurality of first receptacles disposed in the outer wall of the box body, the plurality of first receptacles fluidically connected to the first duct and configured to receive a plurality of first tube bodies of the plurality of tube bodies;

wherein the plurality of receptacles further includes a plurality of second receptacles disposed in the outer wall of the box body, the plurality of second receptacles fluidically connected to the second duct and configured to receive a plurality of second tube bodies of the plurality of tube bodies; and wherein the central web is structured to form the injection tube.

2. The receiving box according to claim 1, wherein the at least one outlet opening opens directly into the associated duct.

3. The receiving box according to claim 1, wherein:

the central web is double-walled including a first wall and a second wall;

the first wall of the central web partially defines the first duct in the box body; and the second wall of the central web partially defines the second duct in the box body.

4. The receiving box according to claim 1, wherein a through flow cross section of the injection tube is smaller than a through flow cross section of each of the plurality of ducts.

5. The receiving box according to claim 1, wherein an opening flow area via which the at least one outlet opening is connected to the associated duct is disposed at an angle of 30° to 170° relative to a receptacle flow area of at least one receptacle of the plurality of receptacles that extends into the associated duct.

6. The receiving box according to claim 1, wherein the box body further includes a connection opening for fluidically supplying the receiving box, and wherein the injection tube further includes an inlet opening disposed on an end side of the injection tube and fluidically connected to the connection opening.

7. The receiving box according to claim 6, wherein the associated duct is fluidically connected to the connection opening via the at least one outlet opening.

8. The receiving box according to claim 1, wherein the at least one outlet opening includes at least two outlet openings that are disposed spaced apart from one another along the injection tube.

9. The receiving box according to claim 1, wherein the box body is composed of a cohesive material.

10. A heat exchanger, comprising:

a plurality of tube bodies through which a first flow path for a first fluid extends;

the plurality of tube bodies arranged in a second flow path for a second fluid, the second fluid path fluidically separated from the first flow path; and a receiving box including a box body defining at least one duct;

the box body including:

a plurality of receptacles configured to receive the plurality of tube bodies of the heat exchanger; and a double-walled portion defining an injection passage;

the injection passage extending along the at least one duct and separated from the at least one duct via a wall of the double-walled portion of the box body;

the wall of the double-walled portion including at least one outlet opening fluidically connecting the injection passage to the at least one duct;

wherein the plurality of tube bodies are received in the plurality of receptacles and are each fluidically connected to the at least one duct; and wherein the first flow path extends through the receiving box.

11. The heat exchanger according to claim 10, wherein the box body further includes a connection opening for fluidically supplying the receiving box, and wherein the wall of the double-walled portion further includes an inlet opening disposed on an end side of the injection passage and fluidically connected to the connection opening.

12. A receiving box for a heat exchanger, comprising:

a box body defining a plurality of ducts;

the box body including a plurality of receptacles configured to receive a plurality of tube bodies of the heat exchanger, the plurality of tube bodies each fluidically connected to an associated duct of the plurality of ducts;

the box body further including a double-walled central web separating the plurality of ducts;

the double-walled central web including:

a first wall at least partially defining a first duct of the plurality of ducts;

a second wall at least partially defining a second duct of the plurality of ducts; and an injection passage defined by and between the first wall and the second wall;

wherein the injection passage extends along at least one duct of the plurality of ducts; and wherein at least one of the first wall and the second wall includes a plurality of outlet openings that fluidically connect the injection passage to a respective duct of the plurality of ducts.

13. The receiving box according to claim 12, wherein the plurality of outlet openings respectively extend into the respective duct.

14. The receiving box according to claim 12, wherein a through flow cross section of the injection passage is smaller than a through flow cross section of at least one duct of the plurality of ducts.

15. The receiving box according to claim 12, wherein the plurality of outlet openings are disposed spaced apart from one another in a longitudinal direction of the injection passage.

16. The receiving box according to claim 12, wherein an opening flow area via which at least one of the plurality of outlet openings is connected to the respective duct is disposed at an angle of 30° to 170° relative to a receptacle flow area of at least one receptacle of the plurality of receptacles that extends into the respective duct.

17. The receiving box according to claim 1, wherein the central web is formed by at least one portion of the outer wall.

18. The receiving box according to claim 1, wherein:

a first end of the outer wall is bent around to contact an intermediate portion of the outer wall and form the first duct;

a second end of the outer wall, which is disposed opposite the first end, is bent around to contact the intermediate portion of the outer wall and form the second duct; and a first portion of the outer wall, which is disposed adjacent to the first end, and a second portion of the outer wall, which is disposed adjacent to the second end, lie against one another to form the central web.

19. The receiving box according to claim 3, wherein:

the first wall and the second wall form the injection tube; and a passage of the injection tube is defined by and between the first wall and the second wall.

20. The receiving box according to claim 3, wherein the first wall and the second wall are portions of the outer wall disposed at opposite ends of the outer wall.

* * * * *